United States Patent [19]

Bondoc et al.

[11] 4,242,404

[45] Dec. 30, 1980

[54] HIGH-STRENGTH GLASS FIBER MAT PARTICULARLY USEFUL FOR ROOFING PRODUCTS

[75] Inventors: Alfredo A. Bondoc, Middlesex; V. Robert Canfield, Martinsville; B. Randall Ziegler, Freehold, all of N.J.

[73] Assignee: GAF Corporation, New York, N.Y.

[21] Appl. No.: 39,577

[22] Filed: May 16, 1979

[51] Int. Cl.[3] ..... B32B 27/00

[52] U.S. Cl. ..... 428/220; 162/156; 428/288; 428/289; 428/290; 428/297; 428/299; 428/302; 428/303

[58] Field of Search ..... 428/288, 289, 290, 293, 428/294, 295, 297, 299, 302, 426, 399, 374, 392; 162/149, 156

[56] References Cited

U.S. PATENT DOCUMENTS

| | | | |
|---|---|---|---|
| 3,684,645 | 8/1972 | Temple et al. | 264/257 |
| 3,956,564 | 5/1976 | Hillig | 428/364 |
| 4,044,188 | 8/1977 | Segal | 264/257 |
| 4,112,174 | 9/1978 | Hannes et al. | 428/297 |
| 4,135,029 | 1/1979 | Pfeffer | 428/297 |

*Primary Examiner*—James J. Bell

*Attorney, Agent, or Firm*—James Magee, Jr.; Dr. Walter Katz

[57] ABSTRACT

What is provided herein is a glass fiber mat having a novel structure and high-strength properties which is particularly useful for roofing products, including built up roofing membranes and systems.

The glass mat of the invention is comprised of two fibrous components, namely, individual filament glass fibers and extended glass fiber elements, which are formed in situ in a wet-laid process from original bundles of glass fibers. The individual filaments appear by conventional filamentation of the bundles. The extended fiber elements, however, are formed by longitudinal extension of a given bundle whose fibers are connected longitudinally. Thereby the effective length of a fiber element is very much greater than the length of the fibers therein. The fiber elements are further characterized by a non-uniform diameter, as contrasted to the fibers themselves, being thicker in the mid-section of the element where connection of fibers is maximized, and tapered towards its ends, where fiber connection is at a minimum.

The extended fiber elements preferably predominate by weight of the fibrous content of the mat over the individual filaments. The desired ratio of the two components is achieved by using bundles whose fibers have a long length, and by very gentle agitation of the dispersion slurry for a short period of time.

8 Claims, 2 Drawing Figures

HIGH-STRENGTH GLASS FIBER MAT PARTICULARLY USEFUL FOR ROOFING PRODUCTS

BACKGROUND OF THE INVENTION

1. Field of the invention

This invention relates to glass fiber mats, and more particularly, to an improved, high-strength glass fiber mat which is particularly useful for roofing products, including built up roofing membranes and systems.

2. Description of the Prior Art

Roofing products which use glass fiber mats in place of organic felts require mats having high-strength properties. Built up roofing membranes and systems, especially, need mats which have excellent tear resistance. Unfortunately, the glass fiber mats of the prior art, which rely upon continuous strands or elongated, rod-like bundles of fibers as reinforcing agents, often are expensive and more difficult to make, and do not possess these high-strength properties, particularly for built up roofing application. Such glass mats are described in a number of U.S. Pat. Nos. including 3,634,054; 3,853,683; 4,112,174; 4,129,674; 4,135,022 and 4,135,029.

Therefore, it would be of considerable advantage to the roofing industry to provide a new and improved high-strength glass fiber mat which is adaptable for built up roofing membranes and systems, and which may be made by a simple, economical, wet-laid process using inexpensive, chopped bundles of glass fibers as the raw material for the mat.

RELATED COPENDING PATENT APPLICATIONS (a) U.S. patent application, Ser. No. 851,683, filed Nov. 11, 1977 (FPN-1062), assigned to the same assignee as herein, describes a process of making uniform glass filament mats from an aqueous dispersion composition formed from bundles of glass fibers and a tertiary amine oxide dispersant.

(b) U.S. patent application, Ser. No. 039,575, filed May 16, 1979 concurrently herewith, (FDN-1193/A), by the same named inventors, and assigned to the same assignee, as this invention, relates to high-strength built up roofing membranes and systems using the glass fiber mat structure described and claimed herein.

(c) U.S. patent application, Ser. No. 039,578, filed May 16, 1979 concurrently herewith (FDN-1193/B) by the same named inventors, and assigned to the same assignee as this invention, relates to a wet-laid method of making the high-strength glass fiber mat claimed herein.

SUMMARY OF THE INVENTION

What is provided herein is a glass fiber mat having a novel structure and high-strength properties which is particularly useful for roofing products, including built up roofing membranes and systems.

The glass mat of the invention is comprised of two fibrous components, namely, individual filament glass fibers and extended glass fiber elements, which are formed in situ in a wet-laid process from original bundles of glass fibers. The individual filaments appear by conventional filamentation of the bundles. The extended fiber elements, however, are formed by longitudinal extension of a given bundle whose fibers are connected ongitudinally. Thereby the effective length of a fiber element is very much greater than the length of the fibers therein. The fiber elements are further characterized by a non-uniform diameter, as contrasted to the fibers themselves, being thicker in the mid-section of the element where connection of fibers is maximized, and tapered towards its ends, where fiber connection is at a minimum.

The extended fiber elements preferably predominate by weight of the fibrous content of the mat over the individual filaments. The desired ratio of the two components is achieved by using bundles whose fibers have a long length, and by very gentle agitation of the dispersion slurry for a short period of time.

DETAILED DESCRIPTION OF THE INVENTION

Figure 1:
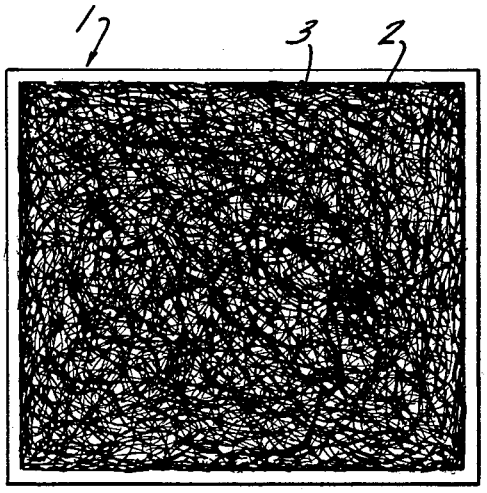
FIG. 1 is a photograph of the novel high-strength glass fiber mat of the invention.

Turning now to the drawings, and particularly to FIG. 1, the novel high-strength glass fiber mat structure of the invention is shown and it is generally designated by reference numeral 1. The mat is comprised of two fibrous components, namely, a plurality of individual glass filaments fibers 2 and a plurality of extended glass fiber elements 3, both of which are substantially randomly oriented and uniformly dispersed throughout the mat. A binder substance (not shown) is provided to hold the fibrous materials together.

Figure 2:
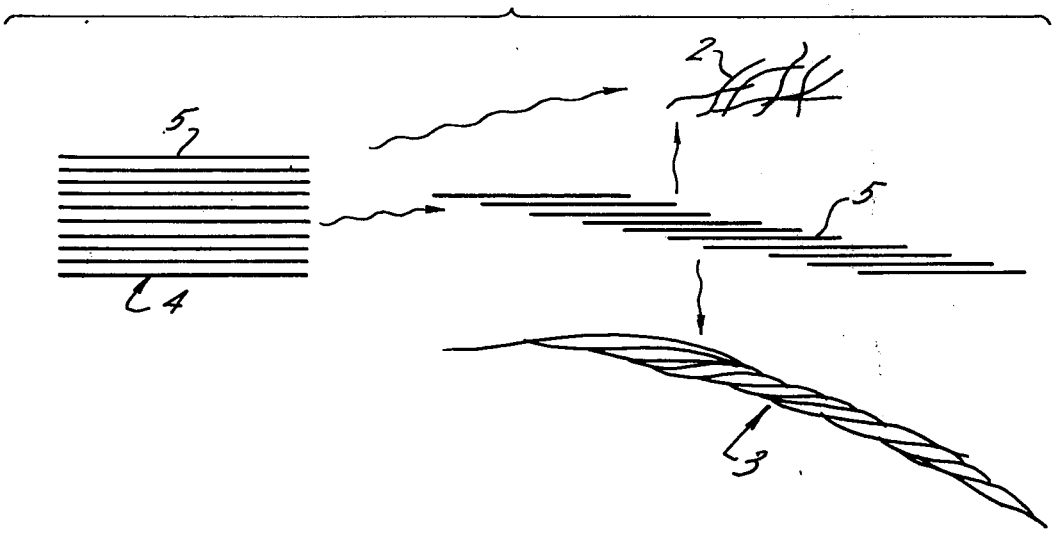
FIG. 2 is a schematic representation of the formation in a wet-laid process of the two fibrous components of the glass mat of the invention.

FIG. 2 illustrates schematically the manner of formation in a wet-laid process of the two fibrous components of the glass mat of the invention. In this process, chopped bundles 4 of glass fibers of rather long length (described later) are added to an aqueous solution of a suitable dispersant in a mixing tank. Each bundle contains many fibers 5, often between 20 to 300 fibers, or more, per bundle. The fibers in these bundles may be sized or unsized, wet or dry, as long as they can be suitably dispersed in the aqueous dispersant medium.

The mixture of fiber bundles in the aqueous dispersement medium then is agitated very gently to form a dilute fiber slurry of selected consistency. During this agitation, some of the fibers in the bundles become filamentized, i.e. form individual filaments. The remaining fibers in a partially filamentized bundle (or fibers in an original unfilamentized bundle) then slide apart but remain connected longitudinally to form an extended glass-fiber element. These fiber elements thereby have an effective length which exceeds that of the fibers themselves within the element. The diameter, of a fiber element, also is non-uniform, as contrasted to the fibers therein, being greater in the middle portion thereof, where connection of fibers is greatest, than at its ends where connection of fibers is at a minimum. Thus the fiber element taper outwardly from the middle towards each end portion thereof.

A single source of fiber bundles having the same physical and chemical properties, including length, diameter, sizing, electrical characteristics, etc. may be used in the process of forming the glass mats of the invention. Alternatively, however, bundles with fibers of differing dimensions may be used.

The extended fiber elements of the glass mat contribute substantially to the high-strength properties of the mat while the individual filaments provide the uniform denseness necessary for impregnation of asphalt in the manufacture of roofing products. Accordingly, the individual filaments suitably are present in the glass mat in an amount of about 20% to 60% by weight of the total fibrous material, while the extended fiber elements comprise about 40% to 80%. Preferably, however, the individual filaments comprise only about 30% to 50% by weight of the mat and the fiber elements about 50% to 70%. In the best mode of the invention, the individual filaments constitute 40% and the extended fiber elements predominate at about 60% of the mat.

The glass fibers in the bundles are selected to have a relatively long length, suitably, about $1\frac{3}{4}$ to 3 inches, preferably about 2 to $2\frac{1}{2}$ inches, and, optimally, $2\frac{1}{4}$ inches in length. The use of longer fibers provides more extended fiber elements in the mat at the expense of individual filaments for a given degree of agitation. The fiber diameter is not a critical parameter. For practical reasons, however, commercial fibers have a diameter of about 8 to 20 microns, and, preferably about 12 to 16 microns, are used.

Mild agitation of the dispersion slurry for short periods of time favors the formation of the desired ratio of individual filaments to extended fiber elements. Clearly, the intense agitation normally employed in wet-laid processes for making uniform glass mats is not used here. Such agitation forms highly filamentized glass mats from fiber bundles which do not contain the substantial amount of extended fiber elements which are an essential part of the mat of this invention. However, conventional mixing equipment may be utilized as long as agitation is carried out at relatively low propeller speeds and for short periods of time. Usually, for handsheets, e.g. using a 4-liter slurry, for example, about 1.5 watt-hour of energy is applied for each 5 minutes of agitation. Usually agitation is continued for less than 30 minutes, and preferably for only about 5 to 15 minutes. In commercial equipment, using very large mixing tanks, mild agitation for short periods of time also is used.

Any suitable dispersant material may be used to form the fiber dispersion slurry. Many such dispersants are known in the art and are available for this purpose. However, a particularly useful dispersant is a tertiary amine oxide, such as Aromox DMHT, which is diemthyl hydrogenated tallow amine oxide, sold by Armak Chemical Co., and described in the aforementioned copending application. This dispersant suitably is used in a concentration of about 2 to 100 ppm, preferably about 5 to 30 ppm, and, optimally, about 10 ppm, of the fiber slurry.

The dispersion slurry suitably is maintained at a dispersion consistency of about 0.1 to 2% by weight of the fibers in the slurry, preferably about 0.2 to 1%, and, optimally, about 0.5%. As in the usual wet-laid processes, the concentrated dispersion slurry is diluted with water before being applied to the mat-forming screen. Preferably the dispersion slurry is diluted about 5 to 25 times at the screen, and, optimally, about 10 times. Generally, higher dispersion and formation consistencies favor generation of extended fiber elements at the expense of individual filaments.

The glass mat thus-formed then is provided with a suitable binder to hold the fibrous components together. Any commecially available binder may be used, such as urea-formaldehyde or phenol-formaldehyde resins. The binder usually is applied in an amount of about 3 to 45% by weight of the finished mat, preferably about 10 to 30%, and, optimally, about 15 to 20%. Generally, too much binder decreases the porosity of the mat to an unsuitable condition, whereas too little binder diminishes the integrity of the mat unreasonably.

Suitably the basis weight of the finished mat (with binder) should be at least 1 lb/100 sq.ft. (49 g/sq.m.), and, preferably, about 2.0% to 3.0 lbs/100 sq.ft. (98 to 148 g/sq.m.)

The glass mats of the invention also are characterized by very high strength properties. Generally, the mats have an Elmendorf tear strength of about 8 Newtons at a basis weight of 98 g/sq.m. In application in three-ply asphaltic built up roofing systems, such mats provide products having a tensile strength of about 234 lbs/inch (CMD) at 0° F.

The following examples will further illustrate the invention.

PREPARATION OF GLASS MAT OF INVENTION

A. Laboratory Equipment

Example 1

A quantity of sized wet chopped strand fiber, 2 inches in length, 16 mm. in diameter, weighing 3 g. on a dry basis, was added to 4 l. of water containing 20 ppm of Aromox DMHT. The resulting slurry was agitated with a Lightning mixer equipped with a suitable propeller type stirrer set at about 400 rpm. for periods of 5, 10 and 20 minutes. The thus-agitated dispersion slurry composition then was drained through a wire mesh upon which the glass mat was formed. After drying, a urea-formaldehyde binder was applied to form a finished mat having a basis weight of 98 g/sq.m. The resultant glass mat hand sheets had 20%, 35% and 55% individual filaments, and 80%, 65% and 45% extended fiber elements for the 5, 10 and 20 minutes of agitation, respectively.

B. Commercial Equipment

Example 2

60 kg. of K filament, sized, wet chopped strand, 2 inch-glass fibers were fed into an 80 cubic meter tank filled with an aqueous solution containing 10 ppm. of Aromox DMHT. The fiber consistency in the stock solution was 0.4%. The tank was cylindrical, upright, having a diameter of 5 meters, and was equipped with a side entering 3-blade propeller agitator. The blades have a variable slope angle normally set at about 15° to 18°, circular in shape, being about 200 to 250 mm. at the widest point and having rounded, dull edges. The propeller measures about 1300 mm. in diameter and was mounted on a shaft about 200 to 250 mm. in diameter, driven by a motor at about 80 to 120 rpm. The stock was agitated for about 5 minutes; the energy input was about 0.6 kw-hr. for this period of agitation.

The agitated stock then was pumped to a matforming machine. En route the stock was diluted with water containing 10 ppm. of Aromox DMHT to a formation consistency of 0.04%. Thereafter, the mat thus-formed was impregnated with a urea-formaldehyde binder dried and cured. The resultant mat contains about 20% binder and 80% fibrous material having a basis weight of 100 g/sq.m. The fibrous components of the mat comprises about 60% by weight of extended fiber elements and about 40% by weight of substantially individual filaments.

What is claimed is:

1. A high-strength glass fiber mat useful for roofing products which is formed from bundles of glass fibers by the wet-laid process, said fibers having a length of about $1\frac{3}{4}$ to 3 inches and a diameter of about 8 to 20 microns, comprising:

(a) a plurality of individual glass fibers comprising about 20% to 60% by weight of the fibrous material in said mat, (b) a plurality of extended glass fiber elements comprised of longitudinally connected fibers said elements there having a length which is greater than the length of the fibers in said element, and a diameter which is non-uniform, being greater in the mid-portion thereof than at its ends, said elements comprising about 40% to 80% by weight of the fibrous mateial in said mat, both said individual fibers and said extended fiber elements being substantially randomly oriented and uniformly dispersed throughout said material, and, (c) a binder substance to hold said fibrous material together.

2. A glass fiber mat according to claim 1 wherein said individual fibers comprise about 30% to 50%, and said extended fiber elements about 50% to 70%, by weight of the fibrous material in said mat.

3. A glass fiber mat according to claim 1 wherein said individual fibers comprise about 40%, and said extended fiber elements about 60%, by weight of the fibrous material in said mat.

4. A glass fiber mat according to claim 1 wherein the fibers in said bundles have a length of about 2 to $2\frac{1}{2}$ inches.

5. A glass fiber mat according to claim 1 wherein said binder substance consistutes about 10% to 40% by weight of said mat.

6. A glass fiber mat according to claim 1 wherein the basis weight of said mat is at least 1 lb/100 sq.ft.

7. A glass fiber mat according to claim 1 wherein the basis weight of said mat is about 2.0 to 3.0 lbs/100 sq.ft. of said mat.

8. A glass fiber mat according to claim 1 wherein fibers of similar length and diameter are present in both said individual fibers and extended fiber elements.

* * * * *